US006860473B2

(12) United States Patent
Oshima

(10) Patent No.: US 6,860,473 B2
(45) Date of Patent: Mar. 1, 2005

(54) SUPPORTING STRUCTURE AND SUPPORTING BRACKET OF SINGLE TUBE DRIFT GENERATOR RECEIVING CENTRIFUGAL FORCE OF INTERNAL FLUID

(75) Inventor: Masataka Oshima, 1-11-1, Ajiyoshi-cho, Kasuigai-shi, Aichi-ken 486-0968 (JP)

(73) Assignees: Masataka Oshima, Kasugai (JP); OHR Co., Ltd., Iruma (JP)

( * ) Notice: Subject to any disclaimer, the term of this patent is extended or adjusted under 35 U.S.C. 154(b) by 0 days.

(21) Appl. No.: 10/466,780

(22) PCT Filed: Feb. 5, 2001

(86) PCT No.: PCT/JP01/00787

§ 371 (c)(1),
(2), (4) Date: Aug. 4, 2003

(87) PCT Pub. No.: WO02/062456

PCT Pub. Date: Aug. 15, 2002

(65) Prior Publication Data

US 2004/0046269 A1 Mar. 11, 2004

(51) Int. Cl.[7] ..... B01F 3/04
(52) U.S. Cl. ..... 261/79.2; 261/123; 261/126
(58) Field of Search ..... 261/77, 79.1, 79.2, 261/123, 126; 210/220

(56) References Cited

U.S. PATENT DOCUMENTS 3,672,647 A * 6/1972 Murphy et al. ..... 261/121.1
3,969,446 A 7/1976 Franklin, Jr.
4,051,035 A 9/1977 Boschen et al.
4,060,574 A * 11/1977 Verner et al. ..... 261/77
4,098,582 A * 7/1978 Takeda ..... 23/293 R
4,210,613 A * 7/1980 Webb ..... 261/120
4,569,757 A * 2/1986 Moore ..... 210/220
5,466,369 A * 11/1995 Hess et al. ..... 210/220
5,480,593 A * 1/1996 Marcum et al. ..... 261/77
5,605,653 A * 2/1997 DeVos ..... 261/77
6,017,020 A * 1/2000 Baughman et al. ..... 261/36.1
6,032,931 A * 3/2000 Plunkett ..... 261/77

FOREIGN PATENT DOCUMENTS

JP 6-335699 12/1994
JP 10-118476 5/1998

* cited by examiner

*Primary Examiner*—Scott Bushey
(74) *Attorney, Agent, or Firm*—Westerman, Hattori, Daniels & Adrian, LLP

(57) ABSTRACT

The present invention concerns a supporting structure of a single tube drift generator. Supporting brackets (9) are formed by integrating fixed plates (8) extending generally through the overall length of a tube body (2) of a single tube drift generator (1) with support leg members (7) extending in the axial direction of the single tube drift generator (1). The supporting brackets have right and left side frames (9*a*) and (9*b*) integrally forming the fixed plates (8) with the support leg members (7) and the cushioning material (9*c*) provided between the pair of right and left side frames (9*a*) and (9*b*). A plurality of support brackets (9) are disposed on the side surface of the tube body (2) of the drift generator (1), and the tube body (2) of the drift generator (1) is connected, through generally the overall length thereof, to the fixed plates (8) of the support brackets (9).

4 Claims, 6 Drawing Sheets

SUPPORTING STRUCTURE AND SUPPORTING BRACKET OF SINGLE TUBE DRIFT GENERATOR RECEIVING CENTRIFUGAL FORCE OF INTERNAL FLUID

TECHNICAL FIELD

The present invention concerns a supporting structure of a single tube drift generator receiving the centrifugal force of an internal swirling fluid, and a supporting bracket used for the supporting structure.

BACKGROUND ART

A single tube drift generator having a drift path constituent member in a tube body for generating a swirling stream from a fluid flowing in the inside thereof is used generally for aerators (aeration devices) or various kinds of fluid reaction devices.

In the single tube drift generator of this type, when a fluid flowing in the tube body is drifted into a swirling stream by an intense action of a drift path constituent member, it receives the centrifugal force of the swirling fluid and undergoes violent vibrations and quakes. Accordingly, firm fixing of the single tube drift generator of this type on a base involves various problems.

Heretofore, as shown in FIG. 6, a tube body base portion of a single tube drift generator 1 (hereinafter referred to as a drift generator) is fitted to an annular supporting member 21 having an attaching leg member 20 and joined by bolts. In this supporting structure, since the drift generator 1 is supported only by way of the base portion of the drift generator, stresses of the centrifugal force can not be dispersed and the stresses are concentrated locally to each of the portions of the drift generator 1 and the support member 21 to result in the following disadvantages.

Since the supporting member 21 has a constitution of welding the leg member 20 to the annular member and it supports only the base portion of the drift generator 1, cracks 22 tend to occur in welded regions or corroded regions, undergoing localized stresses.

Further, since the vibrations of the drift generator 1 can not be suppressed sufficiently, excess force exerts on bolt-joined regions of the supporting member 21, and the attaching hole is scraped by bolts.

Particularly, when one or both of the tube body and the supporting member 21 of the drift generator 1 is made of a synthetic resin, this results in a trouble such as scraping of bolt attaching holes, and the drift generator is finally detached out of the supporting member. Further, it has been found that since the existent support member 21 has a rigid structure with no resiliency, fatigue caused by the stress of the centrifugal force is accumulated leading to early destruction.

Accordingly, it is an object of the present invention to provide a supporting structure for dispersing stresses of a centrifugal force caused by an internal swirling stream thereby stably supporting a drift generator for a long period of time.

Further, it is an object of the present invention to provide a supporting bracket for use in the supporting structure described above and, particularly, it is an object thereof to provide a supporting bracket capable of absorbing vibrations and quakes caused by the centrifugal force by a resilient soft structure.

DISCLOSURE OF THE INVENTION

In the supporting structure of a single tube drift generator according to the present invention, a tube body fixing plate extending substantially over the entire length of a tube body of a drift generator is formed integrally in the longitudinal direction of a supporting leg member having an attaching portion on a base to constitute a supporting bracket, a plurality of such supporting brackets are disposed to the lateral surface of the tube body of the drift generator, the drift generator is joined substantially over the entire length of the tube body thereof to the fixing plate of each of the supporting brackets, and the supporting leg member of each of the supporting brackets is fixed to the base. This disperses the centrifugal force caused by a swirling fluid inside the tube body and stresses are not centralized locally. Accordingly, the drift generator is stably supported over a long period of time. Further, even in a case of connecting drift generators in a multi-stage since the supporting bracket supports the multi-stage drift generators substantially over the entire length thereof, there is no worry that the connection portions are detached by the vibrations of the centrifugal force and it is also durable to the fluid resistance.

In the supporting bracket according to the present invention for use in the supporting structure of the single tube drift generator, a fixing plate for the tube body extending substantially over the entire length of the drift generator is formed integrally in the longitudinal direction of the supporting leg member having the attaching portion to the base. This constitution can firmly support the drift generator over the entire length of the tube body thereof.

Further, in the supporting bracket used for the supporting structure of the present invention, the supporting bracket comprises a pair of left and right members opposed longitudinally to each other, and buffer members are interposed between the pair of the left and right members and joined integrally. This constitution makes the supporting bracket into a soft structure, which absorbs centrifugal force or vibrations by the resiliency thereof.

Preferably, the supporting leg member has a reinforcing portion enlarged slantwise toward the lower attaching portion, and an engaging portion for receiving the drift generator is disposed to the reinforcing portion on the side abutting against the drift generator.

BRIEF EXPLANATION FOR THE DRAWINGS

BEST MODE FOR PRACTICING THE INVENTION

For disclosing the present invention more in details, a preferred embodiment of the present invention is to be described with reference to the accompanying drawings.

Figure 1:
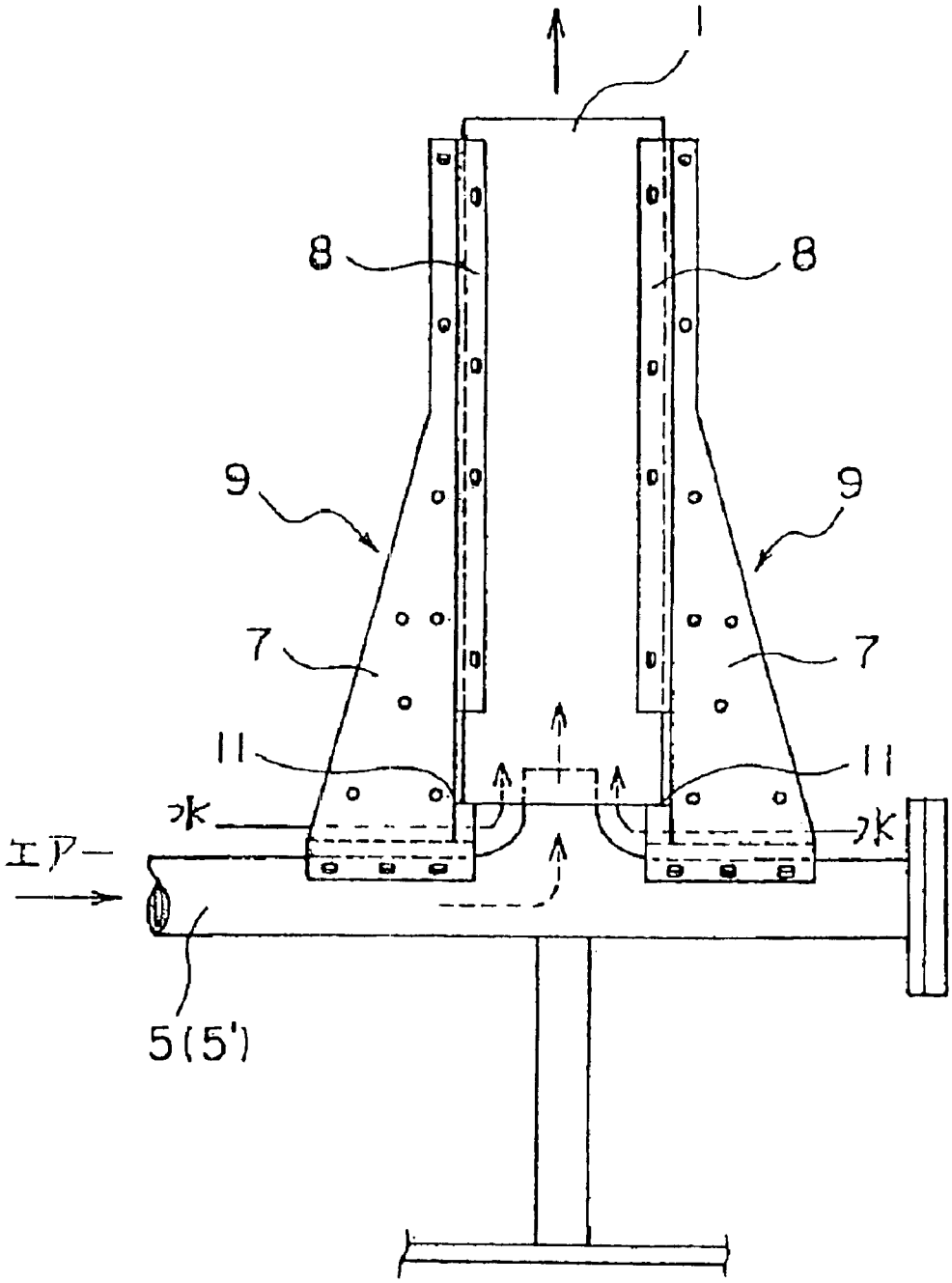
FIG. 1 is a side elevational view for a supporting structure of a single tube drift generator according to the present invention.
Figure 2:
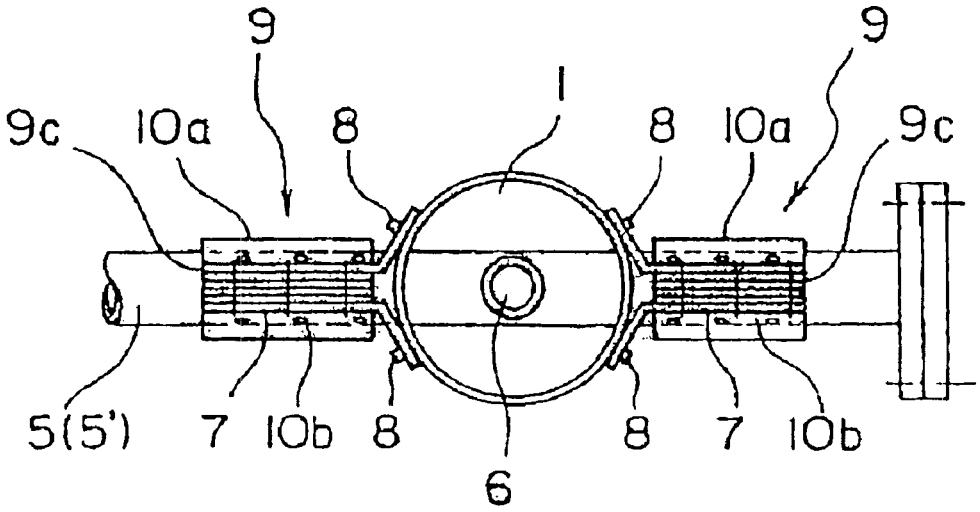
FIG. 2 is a plan view of FIG. 1.

FIG. 1 shows a supporting structure of locating a single tube drift generator 1 (hereinafter simply referred to as a drift generator) used as a gas-liquid mixing·stirring device such as an aerator, at a predetermined position in a predetermined statue according to the present invention.

Figure 3:
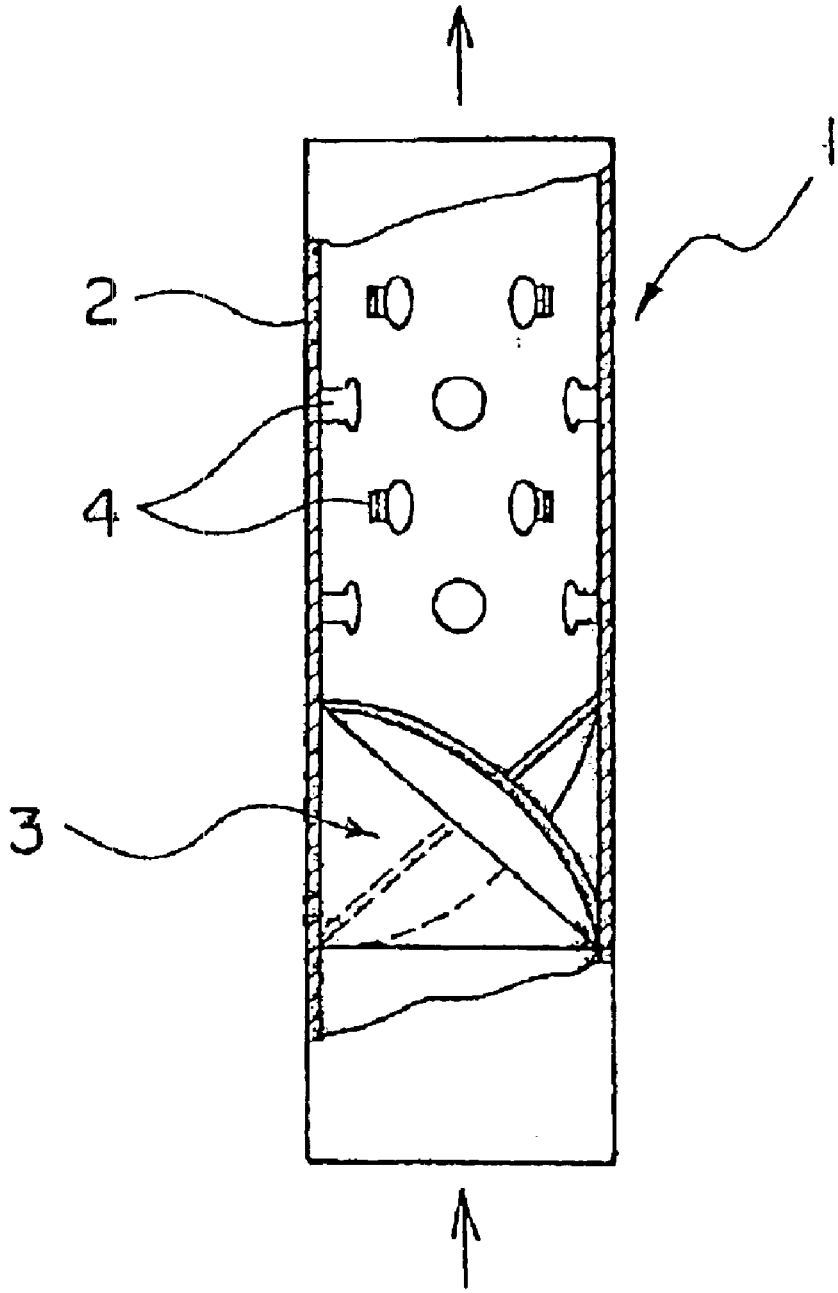
FIG. 3 is a schematic constitutional view of a single tube drift generator according to an embodiment of the present invention.

As shown in FIG. 3, the drift generator 1 of the embodiment in the drawing has a drift path constituent member 3 disposed in a tube body 2 for twisting an internal fluid to form a swirling stream and a plurality of protrusions 4 are fixed to the inner wall of the tube body downstream to the drift path constituent member 3 for colliding the swirling stream to mix and stir the same.

In the embodiment of FIG. 1, the drift generator 1 is located vertically and downwardly above a nozzle 6 of an air supply pipe 5 placed in water to constitute an aerator of supplying under pressure a mixed fluid of air supplied under pressure from the air nozzle 6 and water ascending by buoyancy of air from a portion below the drift generator 1, and drifting the mixed fluid into a swirling stream by the drift path constituent member 3 and then mixing and stirring the same by the protrusions 4.

The drift generator 1 of this type undergoes a centrifugal force when the gas-liquid fluid mixture supplied is drifted into a swirling stream by the drift path constituent member 3 and also undergoes a fluid resistance caused by the drift path constituent member 3 and the protrusions 4. Accordingly, the drift generator 1 has to be attached by a supporting structure capable of withstanding the centrifugal force and the fluid resistance.

For this purpose, as shown in FIG. 1 in the present invention, a plurality of supporting brackets 9 each formed by integrating a fixing plate 8 extending substantially over the entire length of the tube body 2 of the single tube drift generator 1 are used, and the fixing plate 8 for each of the supporting brackets 9 is fixed to the lateral surface of the tube body 2 of the drift generator 1 by means of rivets or the like, and a lower attaching end of each of the supporting brackets 9 is fixed to a base 5' (air supply tube in the embodiment of the drawing).

In the embodiment of FIG. 1, while two supporting brackets 9, 9 are opposed at two left and right positions of the drift generator 1, they are not restricted only thereto but may adopt other arrangement depending on the structure of the base.

As described above, in the supporting structure of the present invention, the tube body 2 of the drift generator 1 is fixed substantially over the entire length by the supporting bracket 9, and supported at several separated positions by a plurality of supporting brackets 9. Accordingly, the stresses of the centrifugal force are dispersed and the tube body undergoes the fluid resistance at the fixed positions over the entire length of the tube body. Therefore, vibrations or quakes of the drift generator 1 are suppressed and the centrifugal force is no more concentrated locally.

Usually, the drift generator 1 is molded from a synthetic resin material and the supporting bracket 9 is formed of a metal such as stainless steel. In this case, it is preferred that the tube body 2 of the drift generator 1 and the fixing plate 8 of the supporting bracket 9 are fitted by riveting to holes formed in both of the members.

Each of the supporting brackets 9 has a constitution comprising an elongate supporting leg member 7 extending in the axial direction of the tube body 2 of the drift generator 1, in which the fixing plate 8 is formed integrally to left and right in the longitudinal direction of the supporting leg member 7 substantially over the entire length of the tube body 2. The fixing plate 8 is formed in an V-shaped or arcuate shaped cross sectional configuration so as to be in contact with the lateral surface of the tube body 2 of the drift generator 1 and extends to the left and right of the supporting leg member 7.

The supporting leg member 7 is reinforced being enlarged slantwise toward the base portion. The base portion constitutes left and right attaching plates 10*a*, 10*b* extending in the lateral direction, and the attaching plates 10*a*, 10*b* are fixed by riveting or the like to the base 5.

As described above, the supporting bracket 9 of the present invention is basically constituted such that the fixing plate 8 extending substantially over the entire length of the drift generator 1 is e formed integrally to the supporting leg member 7 extending in the longitudinal direction of the drift generator 1, and the attaching plates 10*a*, 10*b* are disposed to the base portion of the supporting leg member 7. A more preferred embodiment is shown in FIG. 4.

Figure 4:
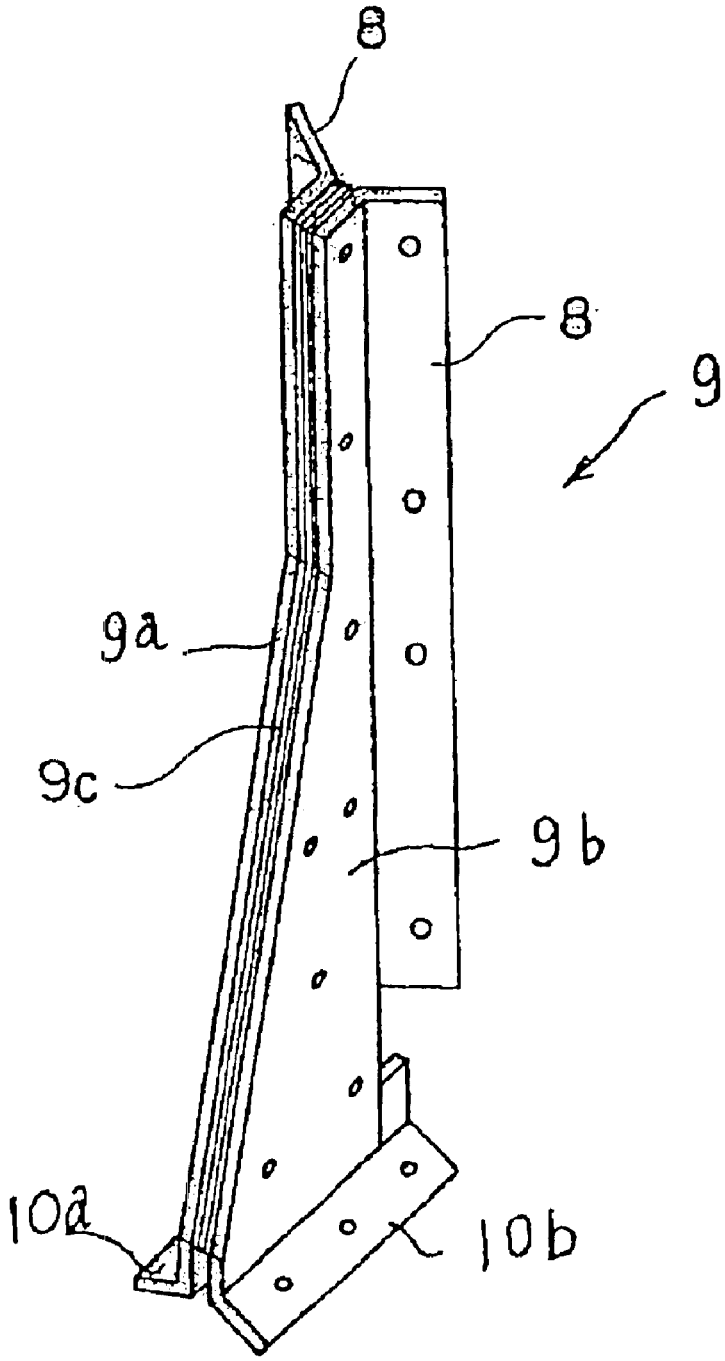
FIG. 4 is a perspective view showing a preferred embodiment of a supporting bracket used for the supporting structure according to the present invention.
Figure 5:
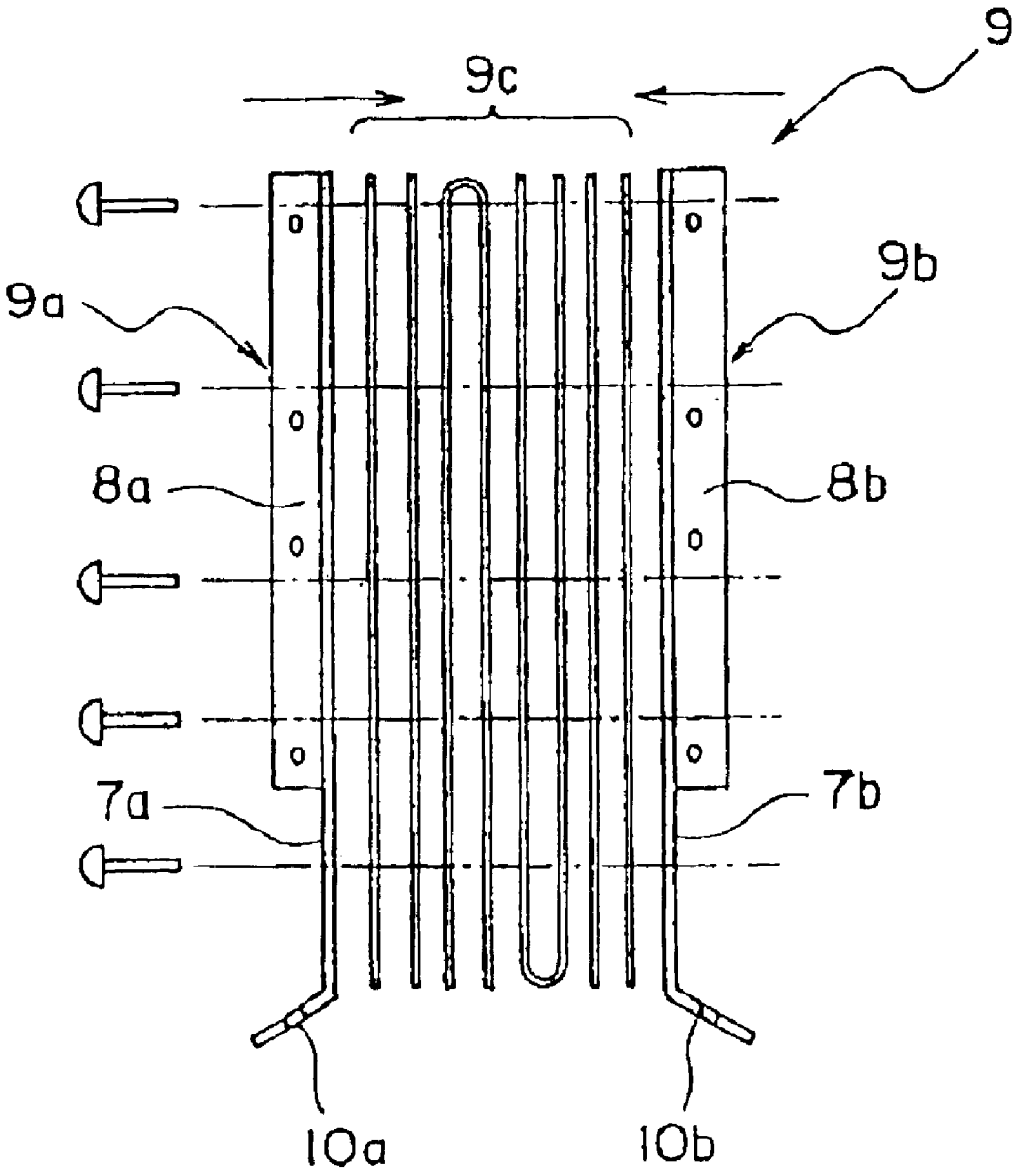
FIG. 5 is an assembled view for the supporting bracket in FIG. 4.
Figure 6:
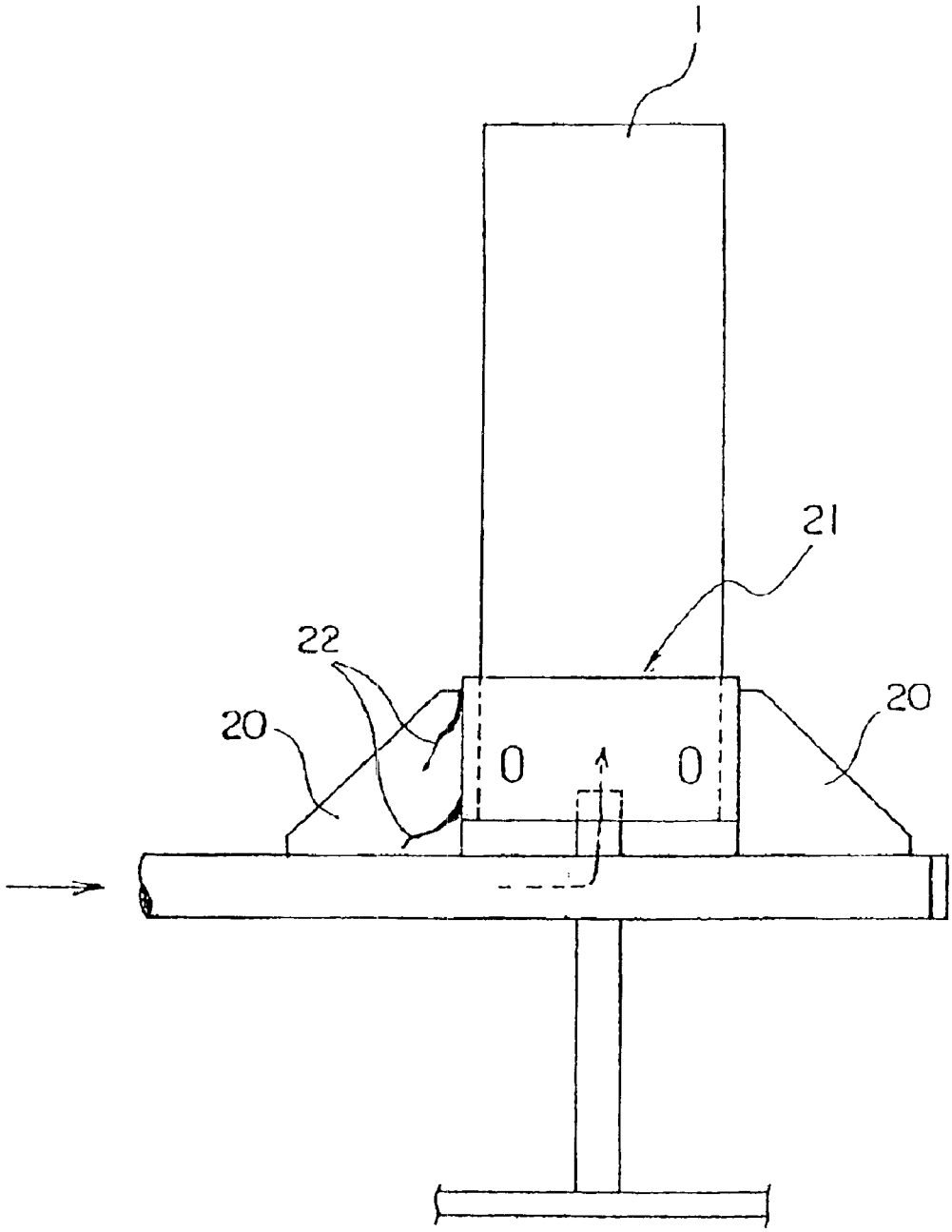
FIG. 6 PRIOR ART
FIG. 6 is a side elevational view of an existent supporting structure.

A supporting bracket 9 in FIG. 4 has constitution comprising a supporting leg member 7 and a fixing plate 8 in which a pair of left and right frames 9*a*, 9*b* formed by longitudinally bisecting them, and buffer members 9*c* such as a shim or rubber member is sandwiched and joined integrally between the frames 9*a* and 9*b*. FIG. 1 shows an embodiment of using the supporting bracket shown in FIG. 4. That is, in the supporting bracket 9 shown in FIG. 4, a divisional fixing plate 8*a* is formed integrally on the left of a divisional supporting leg member 7*a* having a base portion attaching plate 10*a* to form a frame 9*a*, and a divisional fixing plate 8*b* is formed integrally on the right of a divisional supporting leg member 7*b* having the other base portion attaching plate 10*b* to form the other frame 9*b*, and the buffer member 9*c* is sandwiched between a pair of opposed left and right frames 9*a*, 9*b* and integrated by means of rivets or the like.

In a case where the buffer member 9*c* is constituted with a metal plate such as a buffer shim, it is preferred that two double-folded plates are located at the center and the stacked four plates are further put on their left and right sides between two dual plates of a different shape and they are stacked as eight sheets of plates in total.

It is preferred in the supporting bracket 9 of the present invention that a receiving portion 11 is disposed to the lower inner side of the supporting leg member 7 to engage the lower end of the drift generator 1 on the receiving portion 11.

Industrial Applicability

The drift generator according to the present invention is adapted to supply a fluid under pressure into the tube body of the drift generator and used generally as an aerator or a reaction device for various kinds of fluids. Since the tube body of the drift generator is supported substantially over the entire length by the fixing plate of the supporting bracket and the drift generator is supported at a plurality of positions by a plurality of supporting bracket separated from each other, the centrifugal force caused by the internal swirling fluid is dispersed and the stresses are not concentrated locally, so that the drift generator is stably supported for a long period of time.

Also in a case where drift generators are connected in multiple stages, since the supporting brackets support the multi-stage drift generators substantially over the entire length, there is no worry that the connected portions are detached by the vibrations of the centrifugal force and it is also durable to the fluid resistance.

The supporting bracket used for the supporting structure according to the present invention is essential for providing the function and the effect described above and, since the fixing plate extending substantially over the entire length of the drift generator is formed integrally to the supporting leg member, the drift generator can be supported over the entire length of the tube body.

Since the supporting bracket has a constitution being integrated by interposing the buffer member between left and right frames, the supporting bracket is in the soft structure and the centrifugal forces or vibrations are absorbed by the resiliency thereof.

What is claimed is:

1. A supporting structure of a single tube drift generator undergoing the centrifugal force of an internal swirling fluid, characterized in that a fixing plate extending substantially over the entire length of the tube body of the drift generator is formed integrally in the longitudinal direction of a supporting leg member having an attaching portion to a base to constitute a supporting bracket, a plurality of such supporting brackets are disposed on the lateral surface of the tube body of the drift generator, the drift generator is joined substantially over the entire surface of the tube body thereof to the fixing plate of each of the supporting brackets, and the supporting leg member of each of the supporting brackets is fixed to the base.

2. A supporting bracket for a single tube drift generator undergoing the centrifugal force of an internal swirling fluid characterized in that a fixing plate extending substantially over the entire length of the tube body of the drift generator is formed integrally in the longitudinal direction of a supporting leg member having an attaching portion fixed to a base, wherein said fixing plate is fixed to said drift generator.

3. A supporting bracket according to claim 2, wherein the supporting bracket comprises a pair of left and right frames, in which a fixing plate for the tube body is formed integrally to the supporting leg member, and a buffer member is interposed and joined integrally between the frames.

4. A supporting bracket according to claim 2 or 3, wherein the supporting leg member has a reinforcing portion enlarged toward a lower attaching portion, and a receiving portion for engaging the drift generator is disposed to the reinforcing portion on the side abutting against the drift generator.

* * * * *